US012235011B2

(12) United States Patent
Yang et al.

(10) Patent No.: US 12,235,011 B2
(45) Date of Patent: Feb. 25, 2025

(54) INDOOR UNIT APPARATUS OF SPLIT-TYPE AIR CONDITIONER AND METHOD FOR USING THE SAME

(71) Applicants: TIANJIN CHENGJIAN UNIVERSITY, Tianjin (CN); XI'AN UNIVERSITY OF ARCHITECTURE AND TECHNOLOGY, Xi 'An (CN)

(72) Inventors: Bin Yang, Tianjin (CN); Bin Zhou, Tianjin (CN); Xiao Wang, Tianjin (CN)

(73) Assignees: TIANJIN CHENGJIAN UNIVERSITY, Tianjin (CN); XI'AN UNIVERSITY OF ARCHITECTURE AND TECHNOLOGY, Xi'an (CN)

( * ) Notice: Subject to any disclaimer, the term of this patent is extended or adjusted under 35 U.S.C. 154(b) by 470 days.

(21) Appl. No.: 17/720,185

(22) Filed: Apr. 13, 2022

(65) Prior Publication Data

US 2023/0032000 A1 Feb. 2, 2023

(30) Foreign Application Priority Data

Jul. 30, 2021 (CN) ..... 202110876140.5

(51) Int. Cl.
*F24F 13/14* (2006.01)
*F24F 1/0003* (2019.01)
(Continued)

(52) U.S. Cl.
CPC ..... *F24F 13/14* (2013.01); *F24F 1/0003* (2013.01); *F24F 1/0041* (2019.02);
(Continued)

(58) Field of Classification Search
CPC ..... F24F 13/14; F24F 1/0001; F24F 1/0041; F24F 1/0073; F24F 8/22; F24F 13/222;
(Continued)

(56) References Cited

U.S. PATENT DOCUMENTS 4,347,782 A * 9/1982 Hoecke ..... F24F 7/007 454/231
6,010,113 A * 1/2000 Rotering ..... F16K 3/03 251/212

(Continued)

FOREIGN PATENT DOCUMENTS

CN 207132438 U * 3/2018 ..... Y02B 30/70
DE 102007045044 A1 * 3/2009 ..... F24F 1/025

(Continued)

OTHER PUBLICATIONS

Screen capture from YouTube video clip entitled "Kenko Purifier—Filter Replacement Tutorial", 1 page, uploaded on Jan. 25, 2021 by Nikken International Inc. Retrieved from Internet: https://www.youtube.com/watch?v=b8ocqoq4VFY (Year: 2021).*

(Continued)

*Primary Examiner* — Steven B McAllister
*Assistant Examiner* — Amy E Carter
(74) *Attorney, Agent, or Firm* — Hemisphere Law, PLLC; Zhigang Ma

(57) ABSTRACT

An indoor unit apparatus of a split-type air conditioner and a method for using the same are provided, which can realize both of an impinging jet ventilation manner and a displacement ventilation manner. A thin air layer can be formed on the ground through using the indoor unit apparatus of a split-type air conditioner, and the indoor unit apparatus of a split-type air conditioner is adapted to be used both in summer and in winter.

8 Claims, 3 Drawing Sheets

(51) Int. Cl.

| | |
|---|---|
| ***F24F 1/0041*** | (2019.01) |
| ***F24F 1/0073*** | (2019.01) |
| ***F24F 8/22*** | (2021.01) |
| ***F24F 13/22*** | (2006.01) |

(52) U.S. Cl.
CPC ..... *F24F 1/0073* (2019.02); *F24F 8/22* (2021.01); *F24F 13/222* (2013.01); *F24F 2013/227* (2013.01)

(58) Field of Classification Search
CPC .... F24F 2013/227; F24F 1/0076; F24F 11/74; F24F 13/12; F24F 8/108; F24F 8/158; F24F 13/02
USPC ..... 454/284, 184, 187, 75
See application file for complete search history.

(56) References Cited

U.S. PATENT DOCUMENTS

| | | | | |
|---|---|---|---|---|
| 2015/0247648 | A1* | 9/2015 | Soderberg | F24F 13/16 454/334 |
| 2020/0063997 | A1* | 2/2020 | Horvath | F24F 11/0001 |

FOREIGN PATENT DOCUMENTS

| | | | | |
|---|---|---|---|---|
| DE | 102015112977 | A1 * | 2/2017 | F24F 11/30 |
| DE | 202020105240 | U1 * | 10/2020 | A61L 9/20 |
| EP | 3739269 | A1 * | 11/2020 | F24F 1/0007 |

OTHER PUBLICATIONS

Translation of DE 102015112977 (Year: 2017).*
Translation of DE 202020105240 (Year: 2020).*
Machine Translation of CN 207132438 (Year: 2018).*
Translation of DE 102007045044 (Year: 2009).*
Karimipanah et al, "Theoretical and experimental investigation of impinging jet ventilation and comparison with wall displacement ventilation", Dec. 2002, Building and Environment vol. 37, Issue 12, pp. 1329-1342 (Year: 2002).*

* cited by examiner

INDOOR UNIT APPARATUS OF SPLIT-TYPE AIR CONDITIONER AND METHOD FOR USING THE SAME

TECHNICAL FIELD

The present disclosure relates to the technical field of air-conditioning devices, and in particularly to an indoor unit apparatus of a split-type air conditioner and a method for using the same.

DESCRIPTION OF RELATED ART

People generally spend most of their lives indoors, and an air quality of an indoor environment is of great significance to the people's health and work efficiency. A ventilation system will consume a lot of energy when adjusting the air quality of the indoor environment, which may account for about 20 percent to 40 percent of a total energy consumption of a corresponding building. It is a great challenge for the ventilation system to not only provide a comfortable indoor environment, but also realize an effective utilization of energy.

A mixed ventilation manner is currently the most widely used ventilation strategy, which can be used for cooling in summer and heating in winter. For the mixed ventilation manner, supplied air is mixed with indoor air, which can eliminate a load indoors and reduce a pollutant concentration. However, an energy utilization efficiency of the mixed ventilation manner is relatively low, and more energy is consumed for adjusting an indoor temperature. Compared with the mixed ventilation manner, a displacement ventilation manner has a higher energy utilization efficiency. A specific principle of the displacement ventilation manner is: low-speed air is sent out by an air supply outlet at a lower portion of a room, a temperature of the low-speed air is lower than the indoor temperature, and a density of the low-speed air is higher than a density of air in the room, thereby the low-speed air can spread along the ground and form a thin air layer on the ground. The displacement ventilation manner is energy saving, however, heating cannot be provided adequately in winter with this manner due to the low speed of the air.

SUMMARY

In order to solve the problems existing in the related art, the present disclosure provides an indoor unit apparatus of a split-type air conditioner and a method for using the same, which can realize both of an impinging jet ventilation manner and a displacement ventilation manner. A thin air layer can be formed on the ground through using the indoor unit apparatus of a split-type air conditioner, and the indoor unit apparatus of a split-type air conditioner is adapted to be used both in summer and in winter.

To achieve the above objectives, the present disclosure provides the following technical solutions.

In one aspect of the present disclosure, an indoor unit apparatus of a split-type air conditioner is provided. The indoor unit apparatus includes an internally hollow housing, and an interior of the housing from top to down being sequentially arranged with an air return region, a heat exchange region, and an air supply region; where an air return louver is arranged on the housing corresponding to the air return region, and a blower is arranged in the air return region; and where a separator is arranged horizontally in the air supply region, and an air duct is arranged vertically in the air supply region; a baffle is arranged on the separator, an opening angle of the baffle is adjustable, and a connecting hole is arranged in a middle of the baffle; the air duct includes a straight pipe section and a tapered pipe section, an end of the straight pipe section is connected to the connecting hole, a tapered edge of the tapered pipe section is connected to a bottom edge of the housing; and an air supply louver is arranged on the housing corresponding to the air supply region, and a slidable orifice plate is arranged on an inner side of the air supply louver.

In a preferred embodiment, the slidable orifice plate is slidably connected to the housing and configured to shield the air supply louver; and the sildable orifice plate is provided with a plurality of circular holes, a diameter of each of the plurality of circular holes is in a range from 4 millimeters (mm) to 7 mm, and a spacing between each adjacent two of the plurality of circular holes is 4 mm.

In a preferred embodiment, an adjustment angle of blades of the air return louver is in a range from 0 to 90 degrees along a direction of rotating towards outside of the housing; and an adjustment angle of blades of the air supply louver is in a range from 0 to 90 degrees, and openings formed among the blades of the air supply louver face towards the ground.

In a preferred embodiment, a filter screen is arranged in the air return region and horizontally arranged above the blower, an edge of the filter screen is connected to an inner wall of the housing, and the filter screen includes a primary filter layer and an activated carbon filter layer.

In a preferred embodiment, a power of the blower is adjustable, an air supply volume of the blower is adjusted in a range from 0.10 cubic meters per second ($m^3/s$) to 0.77 $m^3/s$, and an air supply direction of the blower is in a direction of facing towards the air supply region.

In a preferred embodiment, an ultraviolet lamp is arranged between the air return region and the heat exchange region, and the ultraviolet lamp is arranged on an inner wall of the housing.

In a preferred embodiment, a coiled pipe, a concave orifice plate and a condensate tray are horizontally arranged in the heat exchange region; where an outlet and an inlet of the coiled pipe are located on the same side, and a bottom of the coiled pipe is connected to the concave orifice plate; where the concave orifice plate is in contact with an inner wall of the housing, a plurality of holes are arranged in a middle portion of a bottom of the concave orifice plate, and the plurality of holes are just aligned with the condensate tray; and where a gap exists between the condensate tray and the inner wall of the housing and is configured to facilitate flowing of air therethrough, a bottom of the condensate tray is provided with a condensate water outlet pipe, and the condensate water outlet pipe extends outside the housing through the air duct.

In a preferred embodiment, a curvature radius of the concave orifice plate is in a range from 4.48 to 4.69, a diameter of each of the plurality of holes of the concave orifice plate is in a range from 5 mm to 10 mm, a spacing between each adjacent two of the plurality of holes is 5 mm, and an opening ratio of the concave orifice plate is in a range from 0.25 to 0.51.

In a preferred embodiment, a bottom of the housing is provided with an arc chamfer, and an arc of the arc chamfer faces towards the outside of the housing.

In another aspect of the present disclosure, a method for using the indoor unit apparatus of a split-type air conditioner described above is provided. When the indoor unit apparatus is in an impinging jet ventilation manner, adjusting a power of the blower to be a high power, enabling high-speed air to enter an area cooperatively defined by an outer wall of the air duct and the housing through an opening portion of the baffle on the separator, and enabling the high-speed air to impinge the outer wall of the air duct and then enter a working area through the air supply louver, and an opening angle of the air supply louver being freely adjustable; when the indoor unit apparatus is in a displacement ventilation manner, adjusting the power of the blower to be a low power, enabling low-speed air to enter the area cooperatively defined the outer wall of the air duct and the housing through the opening portion of the baffle on the separator, adjusting the slidable orifice plate to shield the air supply louver, and enabling the low-speed air to impinge the outer wall of the air duct and then enter the working area through the slidable orifice plate and the air supply louver, and the opening angle of the air supply louver being fixed at a fully opened state.

Compared with the related art, the present disclosure may have at least following beneficial effects.

For the indoor unit apparatus of a split-type air conditioner of the present disclosure, an air supply region is provided in the indoor unit apparatus, and an air impinging jet ventilation manner is adopted in the air supply region, such that: after air impinges an outer wall area of a tapered pipe section of an air duct, a speed of the air drops to an acceptable level due to a damping effect of the ground, so that a "blowing feeling" can be reduced, and a satisfaction degree of a user thereof to the air can be improved. Because a relationship between a buoyancy and a momentum is well balanced by the air impinging jet ventilation manner, the indoor unit apparatus has a smaller average air of age and a better air speed distribution, thereby ensuring that the user can inhale high-quality air and a comfort of the user is improved.

A momentum of supplied air in the impinging jet ventilation manner according to the present disclosure is smaller than that in the mixed ventilation manner, and greater than that in a wall displacement ventilation manner, therefore the air can be directly sent to a bottom of the room for merely adjusting a temperature of an activity area of the user. Compared with the mixed ventilation manner, the indoor unit apparatus of the present disclosure brings out a higher energy utilization efficiency, a more comfortable thermal environment and a more effective removal of local excess heat. Compared with the wall displacement ventilation manner, since the momentum of the supplied air in the impinging jet ventilation manner is greater than that in the wall displacement ventilation manner, a warm current can be sent to the activity area of the user at the bottom of the room in winter. As such, compared with the wall displacement ventilation manner, the indoor unit apparatus of the present disclosure is suitable not only for summer but also for winter, and has a wider application range.

In an embodiment of the present disclosure, a slidable orifice plate is further provided, and is used to completely shield the air supply louvers. When air with a low momentum is sent out from the slidable orifice plate, the impinging jet ventilation manner can be adjusted to the displacement ventilation manner. In the present disclosure, the impinging jet ventilation manner and the displacement ventilation manner can be switched with each other, thereby providing choices for the user. Specifically, the impinging jet ventilation manner and the displacement ventilation manner can be switched according to an area and usage of the room, for improving the user's comfort and satisfaction.

In an embodiment of the present disclosure, a baffle is further provided, and an opening angle of the baffle is adjustable. When the indoor unit apparatus is used, the opening angle of the baffle can be adjusted according to a placement position of the indoor unit apparatus. When the indoor unit apparatus is placed on a wall of a room, the baffle can be adjusted to be in a half opening state; while when the indoor unit apparatus is placed in a corner of the room, the baffle can be adjusted to be in a quarter opening state or a half opening state. According to the present disclosure, the baffle can be adjusted in combination with a millimeter wave radar, and the opening angle of the baffle and the power of the blower can be adjusted according to a density of people in the room. This design can avoid a waste of air volume and further improve an energy utilization efficiency.

Further, in an embodiment of the present disclosure, the housing is further provided with a filter screen and an ultraviolet lamp. When air sequentially passes through the filter screen and an area irradiated by the ultraviolet lamp, the filter screen absorbs a tiny dust and particles in the air and eliminates odor and peculiar smell of the air, and the ultraviolet lamp irradiates light to kill bacteria and fungi in the air, thereby improving a quality of the air.

Further, in an embodiment of the present disclosure, the housing is also provided with a coiled pipe, which cools or heats air to meet the purpose of cooling or heating of the air conditioner. Under a cooling mode, a condensed water produced during an operation of the coiled pipe falls into the concave orifice plate below the coiled pipe, and the condensed water flows into the holes of the concave orifice plate and then drops into the condensate tray below the concave orifice plate due to a gravity of the condensed water. Further, air flows to a lower portion of the indoor unit apparatus through an air passage around the condensate tray. In this case, the air enters a space cooperatively defined by the separator, the outer wall of the air duct and the inner wall of the housing; the air with a high momentum is discharged downward and impinges the outer wall of the air duct and spreads outward; and the air of a high quality forms a thin air layer along a floor. The indoor unit apparatus of the present disclosure enables an air jet resist a buoyancy generated by a heat source and enables the air further reaches the floor, such that a temperature distribution of the room is more uniform, and the comfort of an occupant of the user is improved.

Figure 1:
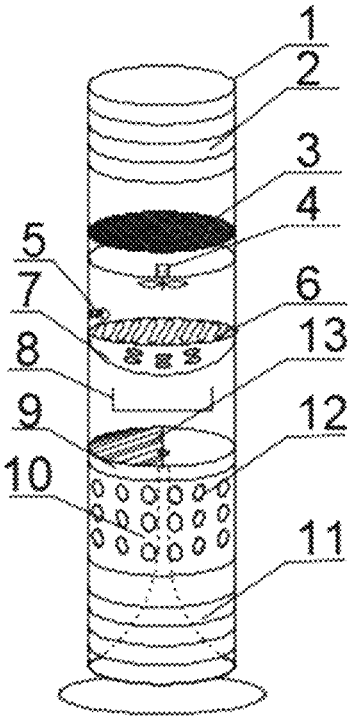
FIG. 1 is a schematic structural view of an indoor unit apparatus of a split-type air conditioner according to an embodiment of the present disclosure.

Reference numerals: 1: Housing; 2: Air return louver; 3: Filter screen; 4: Blower; 5: Ultraviolet lamp; 6: Coiled pipe; 7: Concave orifice plate; 8: Condensate tray; 9: Separator; 10: Air duct; 11: Air supply louver; 12: Slidable orifice plate; 13: Baffle; 14: Condensate water outlet pipe.

DETAILED DESCRIPTION OF EMBODIMENT

The present disclosure will be further explained hereinafter combined with accompanying drawings and specific embodiments.

With reference to FIGS. 1 to 4, an indoor unit apparatus of a split-type air conditioner is provided according to an embodiment of the present disclosure, which can realize both an impinging jet ventilation manner and a displacement ventilation manner. The indoor unit apparatus includes a housing 1, which may be cylindrical or square. An interior of the housing 1 from top to down is sequentially disposed with an air return region, a heat exchange region and an air supply region. An air return louver 2 is arranged on the housing 1 corresponding to the air return region. A filter screen 3 and a blower 4 are sequentially and horizontally arranged below the air return louver 2. A coiled pipe 6, a concave orifice plate 7 and a condensate tray 8 are horizontally and sequentially from up to down arranged in the heat exchange region. A middle of a bottom of the concave orifice plate 7 is provided with multiple holes, which are just aligned with the condensate tray 8. The condensate tray 8 is not directly connected to an inner wall of the housing 1. A separator (also referred to as partition plate) 9 is arranged horizontally in the air supply region. A baffle 13 is arranged on the separator 9, and an opening angle of the baffle 13 can be adjusted. A connecting hole is arranged in the middle of the baffle 13. A first end of an air duct 10 is arranged to the connecting hole, and a second end of the air duct 10 opposite to the first end is connected to a bottom of a side wall of the housing 1. An air supply louver 11 is arranged on the housing 1 corresponding to the air supply region.

In a preferred embodiment, the inner wall of the housing 1 is slidably connected with a slidable orifice plate 12. A width of the slidable orifice plate 12 is equal to a width of the air supply louver 11. The slidable orifice plate 12 can slide from the air supply louver 11 to an upper portion of the air supply louver 11 and from the upper portion of the air supply louver 11 to the air supply louver 11, such that the slidable orifice plate 12 can completely shield the air supply louver 11.

In a preferred embodiment, a power of the blower 4 is adjustable, an air supply volume thereof is adjusted in a range from 0.10 $m^3/s$ to 0.77 $m^3/s$, an air supply direction thereof is a direction of facing downward (i.e., facing towards the air supply region). When the blower 4 is operated at a high power, an air supply speed of the blower 4 is increased, which corresponds to the impinging jet ventilation manner; when the blower 4 is operated at a low power, an air supply speed of the blower 4 is reduced, which corresponds to the displacement ventilation manner.

In a preferred embodiment, an ultraviolet lamp 5 is arranged between the air return region and the heat exchange region. A power of the ultraviolet 5 may be 5 watts (W). The ultraviolet lamp 5 is arranged on the inner wall of the housing 1. Air entering the housing 1 passes through a sterilization area of the ultraviolet lamp 5, such that a concentration of harmful substances in the air is reduced and a quality of the air is enhanced.

In a preferred embodiment, the coiled pipe 6 plays the same function as an ordinary air conditioner coil, and may act as a condenser pipe for cooling in summer and may act as a radiator pipe for heating in winter. Specifically, when cooling is required in summer, the coiled pipe 6 acts as a condenser pipe, and when heating is required in winter, the coiled pipe 6 acts as a radiator pipe.

In a preferred embodiment, the concave orifice plate 7 is in contact with the inner wall of the housing 1. A curvature radius of the concave orifice plate 7 is in a range from 4.48 to 4.69. A diameter of each of the holes of the concave orifice plate 7 is in a range from 5 mm to 10 mm. A spacing between each adjacent two of the holes of the concave orifice plate 7 is 5 mm. An opening ratio of the concave orifice plate 7 is in a range from 0.25 to 0.51.

In a preferred embodiment, the opening angle of the baffle 13 on the separator 9 may be adjusted based on a placement position of the indoor unit apparatus. The adjusting process may be performed by a controller installed on the baffle 13. A model of the controller may be ELMO GOLD Maestro.

Figure 2:
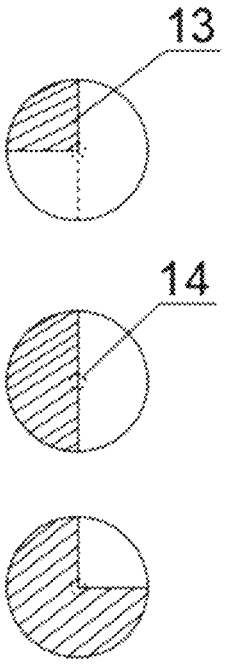
FIG. 2 is a schematic view illustrating adjust manners of a baffle according to an embodiment of the present disclosure.
Figure 3:
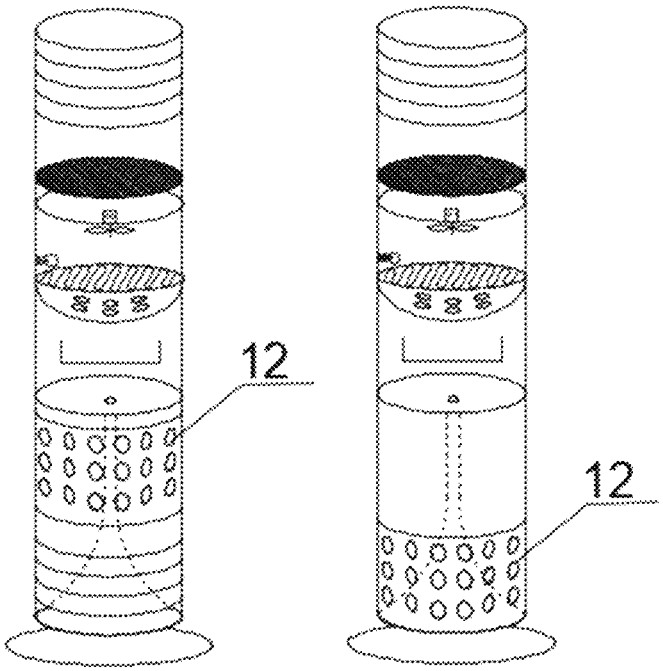
FIG. 3 is a schematic view illustrating an adjust process of a slidable orifice plate according to an embodiment of the present disclosure.
Figure 4:
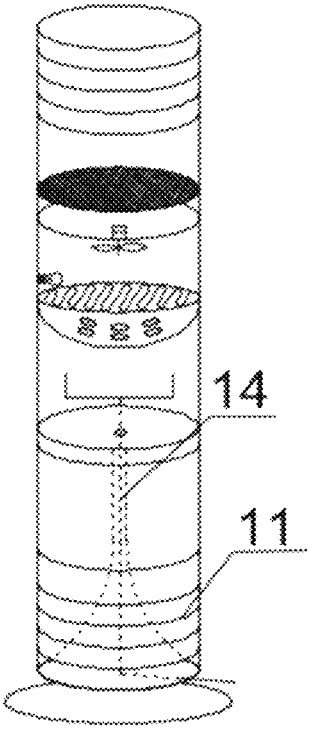
FIG. 4 illustrates a distribution of a condensate water outlet pipe according to an embodiment of the present disclosure.

In a preferred embodiment, as shown in FIG. 2, the baffle 13 is fan-shaped and may be adjusted in any one of following three modes: a three-quarter opening mode, a half opening mode, and a quarter opening mode.

In a preferred embodiment, the condensate tray 8 is connected to a condensate water outlet pipe 14. The condensate water outlet pipe 14 enters the air duct 10 through the connecting hole on the baffle 13 and extends outside of the housing 1.

In a preferred embodiment, the air duct 10 includes a straight pipe section and a tapered pipe section. An end of the straight pipe section is connected to the connecting hole on the baffle 13, and a tapered edge of the tapered pipe section is connected to a bottom edge of the housing 1. The bottom portion of the housing 1 is provided with an arc chamfer, and an arc of the arc chamfer faces towards to the outside of the housing 1.

In a preferred embodiment, the slidable orifice plate 12 is provided with multiple circular holes. A diameter of each of the multiple circular holes is in a range from 4 mm to 7 mm. A distance between each adjacent two of the multiple circular holes is 4 mm. The slidable orifice plate 12 may be adjusted to move up and down by a controller arranged thereon, and a model of the controller may be ELMO GOLD Maestro.

When indoor unit apparatus is used, air enters an interior of the housing 1 from the air return louver 2 at an upper portion of the housing 1, and is filtered by the filter screen 3 to remove some particles in the air and improve a quality thereof. Further, the blower 5 can provide a momentum for causing the air to flow. The ultraviolet lamp 5 may illuminate an area, and sterilize the air obtaining the momentum in the area, thereby to removes some harmful substances in the air, and further improves the quality of the air. After the sterilized air flows through the coiled pipe 6 and performs heat exchanging, a condensed water generated by the coiled pipe 6 and the heat-exchanged air enter the concave orifice plate 7 and flow out from the hole in the middle of the bottom of the concave orifice plate 7. The condensed water then enters the condensate tray 8 due to a gravity thereof; and the heat-exchanged air flows out from a gap between an edge of the condensate tray 8 and the housing 1, or the heat-exchanged air directly enters the condensate tray 8 and bounces back into the gap between the edge of the condensate tray 8 and the housing 1 after being impinged by a bottom of the condensate tray 8.

The heat-exchanged air then flows through an opening portion of the baffle 13 and enters a space formed by an outer wall of the tapered pipe section of the air duct 10, the separator 9 and the inner wall of the housing 1. The heat-exchanged air vertically impinges the outer wall of the tapered pipe section of the air duct 10, so that the heat-exchanged air is spread all around. The heat-exchanged air may flow out horizontally from the air supply louver 11, or in a condition that an opening direction of the air supply louver 11 is fixed, and the slidable orifice plate 12 is adjusted to shield the air supply louver 11, and the heat-exchanged air flows outside through the slidable orifice plate 12.

In a preferred embodiment, a surface of the outer wall of the tapered pipe section of the air duct 10 is curved, such that a resistance applied on the heat-exchanged air during the impinging process of the air is reduced.

In a preferred embodiment, the condensate water outlet pipe 14 enters the air duct 10 through the connecting hole on the baffle 13, and the condensed water from the condensate tray 8 flows outside of the housing 1 through the condensate water outlet pipe 14 in the air duct 10.

With the indoor unit apparatus of a split-type air conditioner of the present disclosure, not only air of a high quality is provided, but also an air lake is formed on a floor through the impinging jet ventilation manner, thereby improving a distribution uniformity of indoor air, providing a better thermal environment, effectively removing a waste heat, and improving an energy utilization efficiency. Also, the present disclosure also provides the displacement ventilation manner. The two manners can be selected according to an area and a usage of a room, and thus a thermal comfort and a usage satisfaction are improved.

First Embodiment

Figure 5:
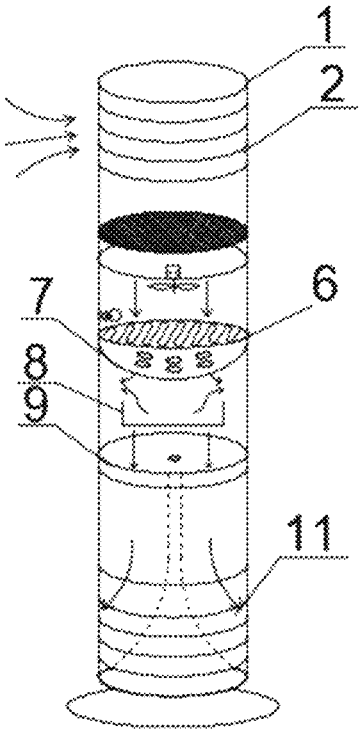
FIG. 5 is a schematic view of flowing of air according to an embodiment of the present disclosure.

As shown in FIG. 5, an indoor unit apparatus of a split-type air conditioner is provided according to a first embodiment of the present disclosure. The indoor unit apparatus includes an internally hollow housing 1 of a height of 1800 mm and a diameter of 445 mm. An upper portion of the housing 1 is provided with an air return louver 2, a filter screen 3 and a blower 4 to define an air return region. A height of the air return louver 2 is 250 mm. An adjustment angle of blades of the air return louver 2 is in a range from 0 to 90 degrees, and the air return louver 2 can be adjusted in a direction facing away from the interior of the housing 1. The filter screen 3 is arranged in the housing 1 and arranged horizontally below the air return louver 2. An edge of the filter screen 3 is connected to the housing 1. The filter screen 3 includes a primary filter layer and an activated carbon filter layer. The activated carbon filter layer is mainly made of an activated carbon filter material. A power of the blower 4 may be adjusted to provide different momentums for air under different operating conditions.

A middle portion of the housing 1 is provided with a coiled pipe 6, a concave orifice plate 7, and a condensate tray 8 to form a heat exchange region. The coiled pipe 6 is a radiator pipe for heating air supplied from the upper portion or a condenser pipe for cooling air supplied from the upper portion. A temperature of air flowing through the coiled pipe 6 changes, such that a condensed water is generated in the coiled pipe 6. The condensed water and the supplied air in the coiled pipe flow out from the hole in the concave orifice plate 7. The condensed water drops into the condensate tray 8 below the concave orifice plate 7 due to a gravity of the condensed water, and the condensed water flows out from the condensed water outlet pipe 14 connected to a bottom of the condensate tray 8. The supplied air flows into a lower portion of the housing 1 from a gap between a edge of the condensate tray 8 and an inner wall of the housing 1 or bounces out from the bottom of the condensate tray 8 after impinging the bottom of the condensate tray 8. As a result, the condensed water is separated from the air. The edge of the condensate tray 8 is set at a certain height relative to the bottom of the condensate tray 8, thereby preventing the condensed water from splashing out after entering the condensate tray 8, which will affect an air supply quality of the indoor unit apparatus.

The lower portion of the housing 1 is provided with a separator 9, an air duct 10 and a baffle 13 to form an air supply region. The supplied air enters an area between an outer wall of the air duct 10 and the housing 1, and air of a high momentum is discharged downward, and impinges a tapered outer wall of the tapered pipe section of the air duct 10 and spreads. After the air of the high momentum impinges the tapered outer wall of the tapered pipe section of the air duct 10, a flow direction thereof changes, and the air of the high momentum flows out horizontally. In this case, the slidable orifice plate 12 does not shield the air supply louver 11, and the air impinging the outer wall of the air duct 10 directly flows out horizontally through the air supply louver 11. During placement of the indoor unit apparatus, a different opening angle of the baffle 13 may be selected according to a different placement position of the indoor unit apparatus in a room where the indoor unit apparatus is placed. If the indoor unit apparatus is placed on a wall of the room, the baffle 13 may be adjusted to be a three-quarters opening state or a half opening state, where a side of the baffle 13 where the air is shielded is close to the wall of the room. If the indoor unit apparatus is placed in a corner of the room, the baffle 13 may be adjusted to be a quarter opening state or the half opening state, where a side of the baffle 13 where the air is shielded is close to the wall of the room. As such, the air can be prevented from entering a gap near a surface of the wall and resulting in an energy waste.

In a preferred embodiment, a power of the blower 4 is required to be adjusted to be a high power. In this case, the air obtains a large momentum and a flow rate of the air is large, and thus an outlet with a large area for the air is required. Therefore, an air supply louver 11 is adopted, and the coiled pipe 6 may be a condenser pipe or a radiator pipe, thereby suitable for cooling in summer or heating in winter.

Further, when cooling is required in summer, the coiled pipe 6 is a condenser pipe, a temperature of the air is decreased after flowing into the coiled pipe 6, and a condensed water is generated. The condensed water enters the condensate tray. The separated high-speed-low-temperature air enters the area between the outer wall of the air duct 10 and the housing 1 through an opening portion of the separator 9. After impinging the outer wall of the air duct 10, a flow direction of the high-speed-low-temperature air changes and thus the high-speed-low-temperature air flows horizontally into a working area through the air supply louver 11, thus achieving the purpose of cooling in summer. When heating is required in winter, the coiled pipe 6 is a radiator pipe, and a temperature of the air is increased after flowing into the coiled pipe 6, and then the air enters the concave orifice plate 7. The separated high-speed-high-temperature air passes through the separator 9, and passes through the area between the air duct 10 and the housing 1. Then, after impinging the outer wall of the tapered pipe section of the air duct 10, a flow direction of the high-speed-high-temperature air changes and thus the high-speed-high-temperature air flows horizontally into the working area through the air supply louver 11, thus achieving the purpose of heating in winter. In this case, an opening angle of the air supply louver 11 can be adjusted freely.

The present embodiment mainly realizes an impinging-jet-typed air supply device. The air of the high momentum is discharged downward, impinges the outer wall of the air duct and spreading, so that the air forms a thin shear layer along a floor of a room. This indoor unit apparatus of the present embodiment generates a high-speed air jet which can resist a buoyancy generated by a heat source, and further reaches a working area (an activity area of a user of the indoor unit apparatus), and improves a uniformity of a temperature distribution of the room and the comfort of the user. This impinging jet ventilation manner is suitable for situations including both cooling in summer and heating in winter.

Second Embodiment

In the present embodiment, a power of the fan 4 is required to be adjusted to be a low power. In this case, the air obtains a low momentum. When the air moves at a low speed, a flow rate thereof is small, a corresponding pressure is small, and an area of an outlet for the air can be reduced. Therefore, a slidable orifice plate 12 is selected, and an even flow is formed when the air with the low speed flows through the slidable orifice plate, thereby improving a comfort of a user of the indoor unit apparatus. Further, the coiled pipe 6 is a condenser pipe. In this case, low-temperature-low-speed air enters the concave orifice plate 7; a condensed water generated in the condenser coil and the low-temperature-low-speed air flows out of the holes of the concave orifice plate 7; and the condensed water is separated from the air.

Further, the low-temperature-low-speed air passes through an area cooperatively defined by the separator 9, the outer wall of the air duct 10 and the housing 1. In this case, the low-temperature-low-speed air flows outside the air duct 10, and the slidable orifice plate 12 is adjusted to shield the air supply louver 11, the low-temperature-low-speed air enters horizontally the working area through the slidable orifice plate 12 and the air supply louver 11.

Specifically, when cooling is required in summer, the coiled pipe 6 is a condenser pipe, a temperature of air is decreased after flowing through the coiled pipe 6, and a produced condensed water enters the condensate tray 8. The separated low-speed-low-temperature air passes through the separator 9, and passes through the slidable orifice plate 12 and enters horizontally the working area through the air supply louver 11. In this case, the air supply louvers 11 is in a fully opened state to achieve the purpose of cooling in summer.

The present embodiment mainly realizes a displacement-ventilation-typed air supply device. The low-temperature and low-momentum air flows out through the slidable orifice plate 12 and directly enters the working area (an activity area of a user of the indoor unit apparatus) at a bottom of a room, thereby improving a temperature efficiency and a ventilation efficiency, which is only suitable for cooling in summer.

Third Embodiment

In the first embodiment, when the blower 4 is adjusted to be operated in a high power, the air supply mode of the indoor unit apparatus is the impinging jet ventilation manner. In this case, an air supply temperature difference in the room is in a range from 3 degrees Celsius (° C.) to 5° C., a load per unit area, i.e., a load density, is in a range from 50 watts per square meter ($W/m^2$) to 80 $W/m^2$, and a total load corresponding to the impinging jet ventilation manner is Q, the minimum value and the maximum value thereof are as follows:

$$Q_{min}=cm\Delta t=1.003\times10^3\times0.5\times3=1504.5W \quad (1)$$

$$Q_{max}=cm\Delta t=1.003\times10^3\times0.77\times5=3861.5W \quad (2)$$

in which: Q refers to a total load of the room, and the unit thereof is W; c refers to a heat capacity of air and has a value of 1.003 kJ/(kg·k); m refers to an air supply volume and the unit thereof is $m^3/s$; and A t refers to an air supply temperature difference and has a value in a range from 3° C. to 5° C.

When the air supply volume m is 0.5 $m^3/s$, a speed of the air from the indoor unit apparatus is 1 m/s. When the air supply volume m is 0.77 $m^3/s$, a speed of the air from the indoor unit apparatus is 1.5 m/s.

A total area of the room suitable for the indoor unit apparatus is A, and the minimum value and the maximum value thereof are as follows:

$$A_{min}=\frac{Q_{min}}{F}=\frac{1504.5}{80}=18.8\ m^2 \quad (3)$$

$$A_{max}=\frac{Q_{max}}{F}=\frac{3861.5}{50}=77.2\ m^2 \quad (4)$$

in which, A refers to a total area of the room, and the unit thereof is square meter ($m^2$); and F refers to a load density and has a value in a range from 50 $W/m^2$ to 80 $W/m^2$. The maximum value of the area of the room suitable for the present disclosure is 77.2 $m^2$.

In the second embodiment, when the blower 4 is adjusted to be operated in a low power, the air supply mode of the indoor unit apparatus is the displacement ventilation manner. In this case, an air supply temperature difference in the room is in a range from 3° C. to 5° C., a load per unit area F is in a range from 30 $W/m^2$ to 50 $W/m^2$, and a total load corresponding to the displacement ventilation manner is Q, which is expressed as follows:

$$Q=cm\Delta t=1.003\times10^3\times0.10\times5=515.9W \quad (5)$$

in which, Q refers to a total load of the room, and the unit thereof is W; c refers to a heat capacity of air and has a value of 1.003 kJ/(kg·k); m refers to an air supply volume and has a value of 0.10 $m^3/s$ and Δt refers to an air supply temperature difference and has a value in a range from 3° C. to 5° C.

The area A of the room suitable for the indoor unit apparatus is as follows:

$$A=\frac{Q}{F}=\frac{515.9}{30}=17.2\ m^2 \quad (6)$$

The maximum value of the area of the room applied in the present disclosure is 17.2 $m^2$.

In summary, the area of the room applied in the present disclosure should be no more than 77.2 $m^2$.

What is claimed is:

1. An indoor unit apparatus of a split-type air conditioner, comprising: an internally hollow housing (1), and an interior of the housing (1) from top to down being sequentially disposed with an air return region, a heat exchange region, and an air supply region;

wherein an air return louver (2) is arranged on the housing (1) corresponding to the air return region, and a blower (4) is arranged in the air return region;

wherein a separator (9) is arranged horizontally in the air supply region, and an air duct (10) is arranged vertically in the air supply region; a baffle (13) is arranged on the separator (9), an opening angle of the baffle (13) is adjustable, and a connecting hole is arranged in a middle of the baffle (13); the air duct (10) comprises a straight pipe section and a tapered pipe section, an end of the straight pipe section is connected to the connecting hole, a tapered edge of the tapered pipe section is connected to a bottom edge of the housing (1); and an air supply louver (11) is arranged on the housing (1) corresponding to the air supply region, and a slidable orifice plate (12) is arranged on an inner side of the air supply louver (11);

wherein a coiled pipe (6), a concave orifice plate (7) and a condensate tray (8) are horizontally arranged in the heat exchange region;

wherein an outlet and an inlet of the coiled pipe (6) are located on the same side, and a bottom of the coiled pipe (6) is connected to the concave orifice plate (7);

wherein the concave orifice plate (7) is in contact with an inner wall of the housing (1), a plurality of holes are arranged in a middle portion of a bottom of the concave orifice plate (7), and the plurality of holes are just aligned with the condensate tray (8); and wherein a gap exists between the condensate tray (8) and the inner wall of the housing (1) and is configured to facilitate flowing of air therethrough, a bottom of the condensate tray (8) is provided with a condensate water outlet pipe (14), and the condensate water outlet pipe (14) extends outside the housing (1) through the air duct (10).

2. The indoor unit apparatus of a split-type air conditioner according to claim 1, wherein the slidable orifice plate (12) is slidably connected to the housing (1) and configured to slidably shield the air supply louver (11); and wherein the slidable orifice plate (12) is provided with a plurality of circular holes, a diameter of each of the plurality of circular holes is in a range from 4 millimeters (mm) to 7 mm, and a spacing between each adjacent two of the plurality of circular holes is 4 mm.

3. The indoor unit apparatus of a split-type air conditioner according to claim 1, wherein an adjustment angle of blades of the air return louver (2) is in a range from 0 to 90 degrees along a direction of rotating towards outside of the housing (1); and wherein an adjustment angle of blades of the air supply louver (11) is in a range from 0 to 90 degrees, and openings formed among the blades of the air supply louver (11) face towards the ground.

4. The indoor unit apparatus of a split-type air conditioner according to claim 1, wherein a filter screen (3) is arranged in the air return region and horizontally arranged above the blower (4), an edge of the filter screen (3) is connected to an inner wall of the housing (1), and the filter screen (3) comprises a primary filter layer and an activated carbon filter layer.

5. The indoor unit apparatus of a split-type air conditioner according to claim 1, wherein a power of the blower (4) is adjustable, an air supply volume of the blower (4) is adjusted in a range from 0.10 cubic meters per second ($m^3/s$) to 0.77 $m^3/s$, and an air supply direction of the blower (4) is a direction of facing towards the air supply region.

6. The indoor unit apparatus of a split-type air conditioner according to claim 1, wherein an ultraviolet lamp (5) is arranged between the air return region and the heat exchange region, and the ultraviolet lamp (5) is arranged on an inner wall of the housing (1).

7. The indoor unit apparatus of a split-type air conditioner according to claim 1, wherein a diameter of each of the plurality of holes of the concave orifice plate (7) is in a range from 5 mm to 10 mm; and a spacing between each adjacent two of the plurality of holes is 5 mm.

8. A method for using the indoor unit apparatus of a split-type air conditioner according to claim 1, comprising:

when the indoor unit apparatus is in an impinging jet ventilation manner, adjusting a power of the blower (4) to be a high power, enabling high-speed air to enter an area cooperatively defined by an outer wall of the air duct (10) and the housing (1) through an opening portion of the baffle (13) on the separator (9), and enabling the high-speed air to impinge the outer wall of the air duct (10) and then enter a working area through the air supply louver (11), and an opening angle of the air supply louver (11) being freely adjustable;

when the indoor unit apparatus is in a displacement ventilation manner, adjusting the power of the blower (4) to be a low power, enabling low-speed air to enter the area cooperatively defined the outer wall of the air duct (10) and the housing (1) through the opening portion of the baffle (13) on the separator (9), adjusting the slidable orifice plate (12) to shield the air supply louver (11), and enabling the low-speed air to impinge the outer wall of the air duct (10) and then enter the working area through the slidable orifice plate (12) and the air supply louver (11), and the opening angle of the air supply louver (11) being fixed at a fully opened state.

* * * * *